US008840459B2

(12) United States Patent
Anderson et al.

(10) Patent No.: US 8,840,459 B2
(45) Date of Patent: Sep. 23, 2014

(54) GAMING MACHINE WITH COLLECTIBLE GAME CARDS

(75) Inventors: Peter R. Anderson, Chicago, IL (US); Joel R. Jaffe, Glenview, IL (US); Shridhar P. Joshi, Naperville, IL (US); Larry J. Pacey, Northbrook, IL (US); Richard T. Schwartz, Chicago, IL (US); Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 1279 days.

(21) Appl. No.: 12/161,837

(22) PCT Filed: Feb. 16, 2007

(86) PCT No.: PCT/US2007/004286

§ 371 (c)(1),
(2), (4) Date: Jul. 23, 2008

(87) PCT Pub. No.: WO2007/098117

PCT Pub. Date: Aug. 30, 2007

(65) Prior Publication Data

US 2009/0082088 A1 Mar. 26, 2009

Related U.S. Application Data

(60) Provisional application No. 60/774,919, filed on Feb. 17, 2006.

(51) Int. Cl.

| | |
|---|---|
| ***A63F 9/24*** | (2006.01) |
| ***A63F 1/04*** | (2006.01) |
| ***G07F 17/32*** | (2006.01) |

(52) U.S. Cl.

CPC ..... *A63F 1/04* (2013.01); *G07F 17/3255* (2013.01)

USPC ..... 463/21; 463/29; 463/43

(58) Field of Classification Search

CPC ..... A63F 1/04; G07F 17/3255

USPC ..... 463/21, 29, 43

See application file for complete search history.

(56) References Cited

U.S. PATENT DOCUMENTS 6,009,458 A * 12/1999 Hawkins et al. ..... 709/203
RE37,957 E * 1/2003 Garfield ..... 273/308

(Continued)

OTHER PUBLICATIONS

International Search Report—PCT/US07/04286 dated Aug. 22, 2008 (2 pages).

(Continued)

*Primary Examiner* — David L Lewis
*Assistant Examiner* — Robert Mosser
(74) *Attorney, Agent, or Firm* — Nixon Peabody LLP

(57) ABSTRACT

A gaming machine for conducting a wagering game includes a plurality of game cards that may be read by one or more card readers of the gaming machine. The game cards may provide a variety of enhancements for the gaming machine, including enhanced game features, enhanced rules of game play, enhanced game characters, and the like. Players may collect the game cards for use in the gaming machine in hopes of increasing their likelihood of achieving a desirable outcome or altering the characteristics of the game to offer more entertaining variations on game play. The players may also trade the game cards with one another and with the casino, thereby creating excitement and interest in the gaming machine. Special interest groups and even entire industries may be formed to facilitate the collecting and trading of the game cards.

27 Claims, 5 Drawing Sheets

(56) References Cited

U.S. PATENT DOCUMENTS

| | | | | |
|---|---|---|---|---|
| 6,991,539 | B2 | 1/2006 | Pacey | 463/16 |
| 7,182,690 | B2 | 2/2007 | Giobbi et al. | 463/24 |
| 7,314,407 | B1 | 1/2008 | Pearson et al. | 463/7 |
| 2002/0151355 | A1 | 10/2002 | Burns et al. | |
| 2002/0151366 | A1* | 10/2002 | Walker et al. | 463/42 |
| 2004/0147309 | A1* | 7/2004 | Chamberlain et al. | 463/25 |
| 2005/0282624 | A1* | 12/2005 | Kane | 463/25 |
| 2006/0040746 | A1* | 2/2006 | Eguchi et al. | 463/43 |
| 2006/0073883 | A1* | 4/2006 | Franks, Jr. | 463/25 |
| 2006/0079317 | A1 | 4/2006 | Flemming et al. | 463/20 |
| 2006/0116192 | A1* | 6/2006 | Okada | 463/20 |
| 2007/0167239 | A1* | 7/2007 | O'Rourke | 463/42 |
| 2007/0197275 | A1 | 8/2007 | Gagner et al. | 463/16 |
| 2009/0170593 | A1 | 7/2009 | Pacey | 463/25 |

OTHER PUBLICATIONS

Written Opinion of the International Searching Authority for International Application No. PCT/US2007/004286, dated Aug. 22, 2008 (3 pages).

International Preliminary Report on Patentability for International Application No. PCT/US2007/004286, dated Mar. 3, 2009 (4 pages).

* cited by examiner

GAMING MACHINE WITH COLLECTIBLE GAME CARDS

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming machine having game enhancements that are available in the form of collectible cards.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, gaming machine manufacturers continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Thus, the bonus game concept offers tremendous advantages in player appeal and excitement relative to other known games.

Another concept that offers tremendous advantages in player appeal and excitement is collectability. Everyone enjoys collecting and most people have one or more favorite items, tangible or otherwise, they like to collect. They may not actually need the items they collect, but merely finding and possessing these items provide a certain appeal and enjoyment. Examples of items people like to collect include art, cars, coins, comic books, dolls, hats, stamps, and trains, to name a few. Special interest groups and even entire industries (e.g., the baseball card industry) have been formed to facilitate collection and trading of certain items.

Accordingly, a need exists for a gaming machine that can build on the enjoyment and excitement people derive from finding and collecting. The present invention is directed to solving this need and other problems.

SUMMARY OF THE INVENTION

According to one aspect of the present invention, a gaming machine for conducting a wagering game comprises a wager input device operable to accept a wager input from a player at the gaming machine. The gaming machine additionally comprises a game display operable to display an outcome of a wagering game in response to the wager input, the outcome being randomly selected from a plurality of outcomes. The gaming machine further comprises a data input device configured to receive one or more handheld data storage media and operable to read data stored on the one or more handheld data storage media into the gaming machine, each handheld data storage medium storing data representing at least one enhancement for the wagering game. The game display is operable to present the at least one enhancement to the player in response to the data input device receiving the one or more handheld data storage media.

According to another aspect of the invention, a method of conducting a wagering game on a gaming machine comprises receiving a wager input from a player at the gaming machine. The method further comprises initiating a wagering game in response to receiving the wager input and allowing a player an opportunity to provide one or more game cards into the gaming machine during the wagering game. In response to the one or more cards being provided by the player, data is read from the one or more game cards into the gaming machine, the data from the one or more game cards representing at least one enhancement for the wagering game. The method finally comprises presenting the at least one enhancement to the player during the wagering game in response to the data from the one or more game cards being read into the gaming machine.

According to yet another aspect of the invention, a method of conducting a wagering game on a gaming machine comprises providing a set of game cards, each game card being associated with at least one enhancement for the wagering game. The method further comprises facilitating collection of the game cards by players of the wagering game and allowing the players an opportunity to input the game cards into the gaming machine. The method finally comprises reading the game cards inputted by the player into the gaming machine and presenting at least one enhancement to the player during the wagering game in response to the game cards being read by the gaming machine.

According to still another aspect of the invention, a computer readable storage medium is encoded with instructions for directing a gaming device to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1:
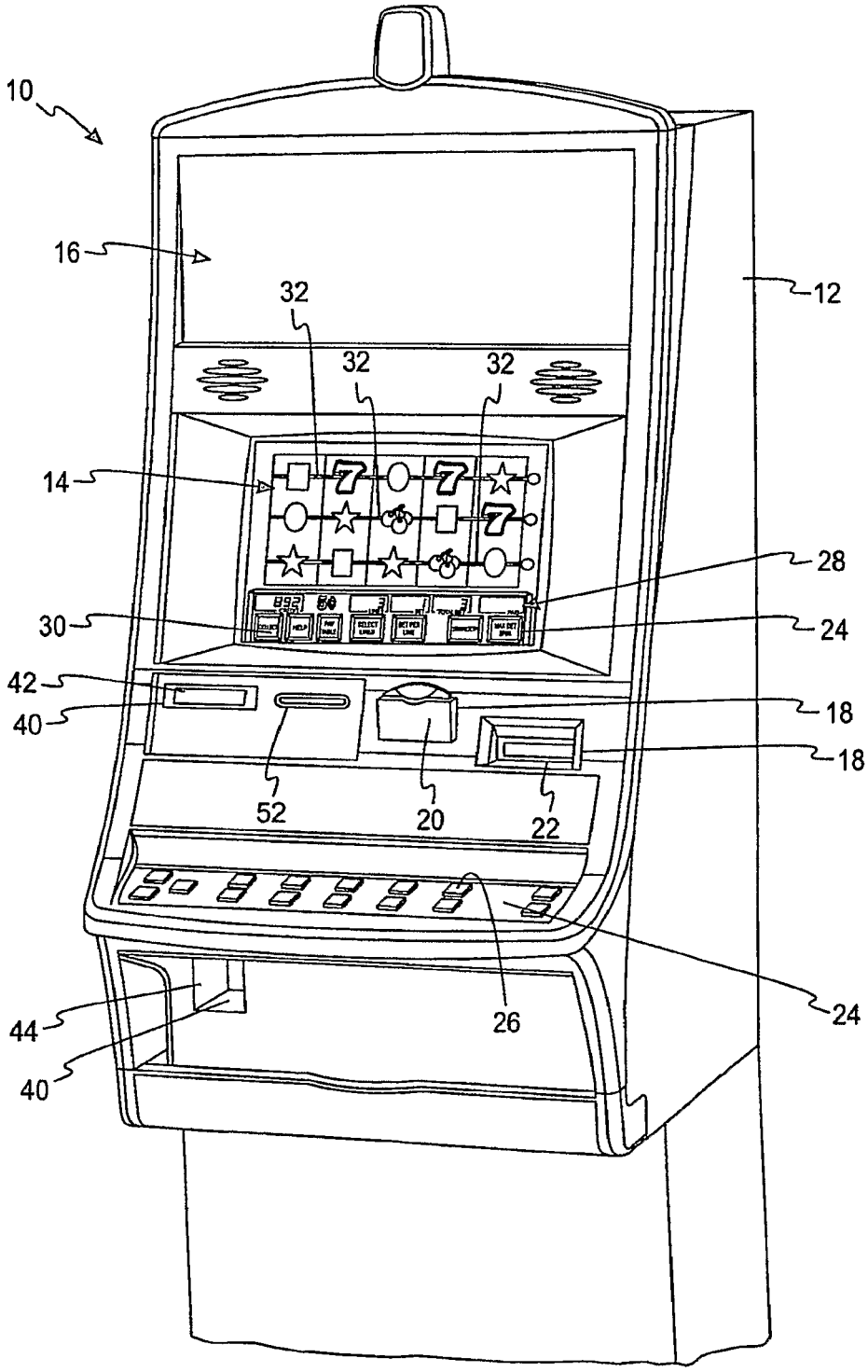
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits which are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an option on how to make their game selections. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming terminal 10. The gaming terminal 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
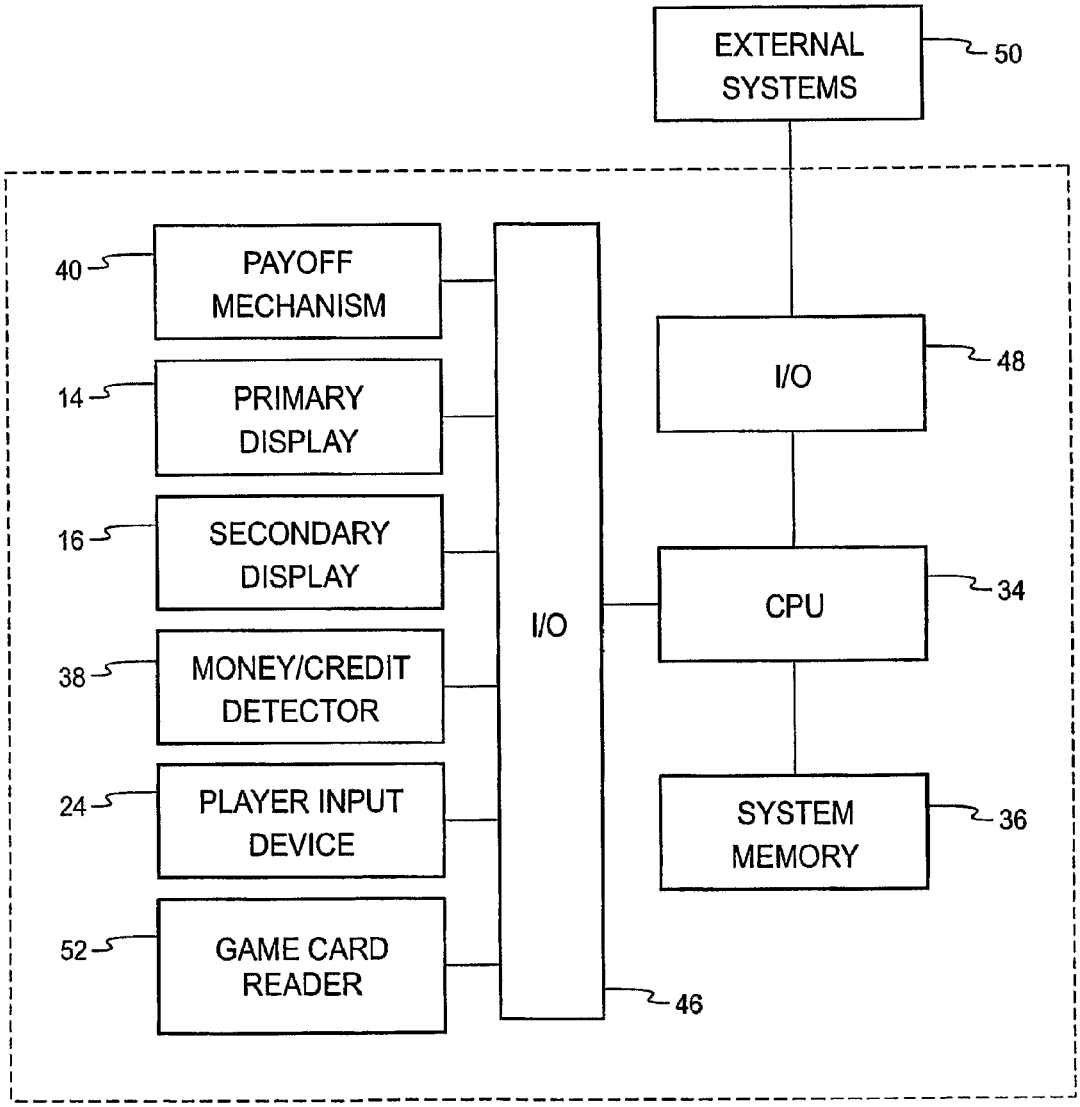
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10 bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

The controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36 maximized As alluded to previously, most people enjoy collecting and have one or more favorite items, tangible or otherwise, they like to collect. In accordance with embodiments of the invention, handheld data storage media may be provided for the gaming machine 10 that players may collect. Such handheld data storage media may provide a variety of enhancements for the gaming machine 10, including new basic and/or bonus game features, augmented game characters, modified rules of game play, and the like. In some embodiments, the handheld data storage media may be implemented as game cards that may be read by a card reader, such as the card reader 52. Players may collect these game cards for use in the gaming machine 10 in hopes of increasing the probability of achieving a desirable outcome or altering the characteristics of the wagering game to offer more entertaining variations on game play. Players may also trade the game cards with one another (and with the casino), thereby creating excitement in the gaming machine 10 amongst the players. Special interest groups and even entire industries (i.e., a collectible economy) may be formed to facilitate the collecting and trading of the game cards.

Figure 3:
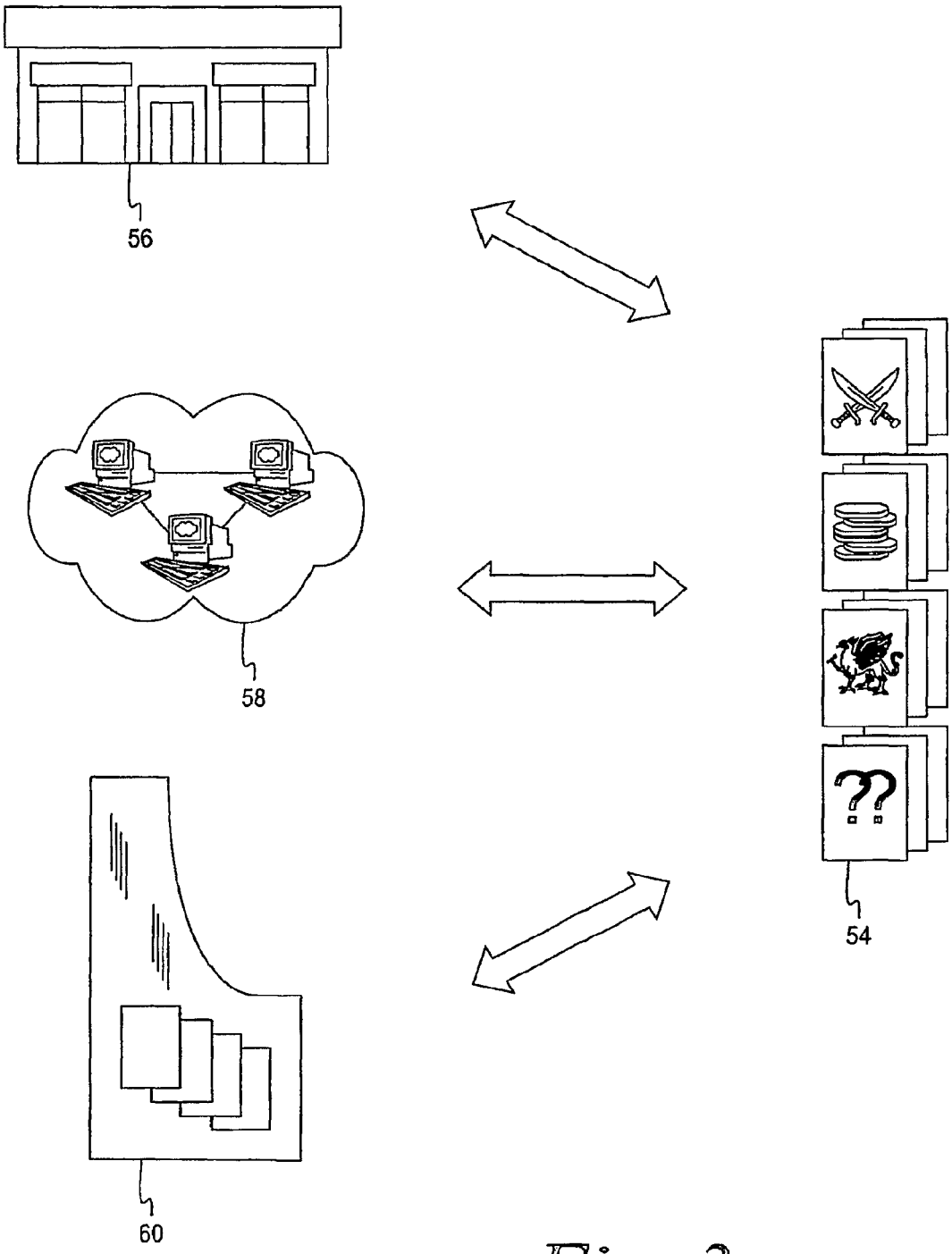
FIG. 3 is a conceptual view of exemplary channels for distributing collectible game cards used with the gaming machine.

An example of collectible game cards is shown generally at 54 in FIG. 3. The depicted game cards 54 resemble a typical credit card, but may also assume other form factors, including game cubes, memory sticks, CD-ROMs, smart cards, memory cards, and the like. Similarly, the data on the collectible game cards 54 may be stored in a variety of ways, including barcodes, magnetic strips, solid-state memory, optical memory, and the like. Each collectible game card 54 may contain a unique computer-readable identifier, or a group of related game cards 54 may carry the same identifier (e.g., all "reel symbol" cards have the same identifier, etc.).

The collectible game cards 54 may also be identified by their appearance. That is, the face and/or back of the collectible game cards 54 may have distinctive graphics, colors, names and/or titles printed thereon. The appearance of a game card 54 may be arbitrary, or it may be indicative of the function of that game card 54. For example, an image of a knife may be imprinted on a "dagger" card, an asterisk on a "wild" card, question marks on a "mystery" card, and so forth. The images and graphics may be two-dimensional or three-dimensional (e.g., holographic images) and may also change as the functions of the collectible game cards 54 change (discussed further below). These images and graphics allow the functions of the collectible game cards 54 to be quickly identified while at the same time making the collectible game cards 54 more visually appealing to players. Indeed, some players may choose to collect certain game cards 54 based on their physical appearance in addition to their functions.

In some embodiment, instead of individual physical cards, the collectible game cards 54 may be virtual cards that are stored electronically, for example, in a personal digital assistant (PDA) or similar handheld device. A player may then connect the handheld device to a desired gaming machine via an appropriate connector (e.g., USB, FireWire, Bluetooth, etc.) to use the virtual game cards. The virtual game cards may also be stored on a game network (e.g., via a digital wallet) to which the gaming machine 10 may be connected. The player may then swipe his/her player identification card in the card reader 52, and the gaming machine 10 retrieves the virtual game cards from the network. The player may then select the particular virtual game cards he/she wishes to use for the wagering game.

It is important for the collectible game cards 54 to be physically and/or electronically secure regardless of their form because of the large sums of money that may be won from the gaming machine 10. Therefore, in the physical implementations, the collectible game cards 54 are preferably tamper-resistant and/or the data and any software stored on the collectible game cards 54 are preferably encrypted. The tamper-resistance and/or encryption may be implemented using any suitable tamper-proofing technology and/or any suitable encryption algorithm known to those having ordinary skill in the art. It is also useful for the cards to be functional across multiple brands of gaming machines and casinos. Therefore, the data and any software on the collectible game cards 54 are preferably in compliance with one or more industry standards for data and software transfer in the gaming machine 10.

Referring still to FIG. 3, the collectible game cards 54 may be provided to the players through a number of different channels. For example, the collectible game cards 54 may be purchased from a retail store 56, ordered from an online merchant 58, obtained through a game card vending machine or kiosk 60, and the like. The game card vending machine or kiosk 60 may be located at any convenient location, for example, on the casino floor near the gaming machine 10. This allows a player to quickly obtain collectible game cards 54 from the game card vending machine or kiosk 60 as needed. Such a need may arise, for example, when a progressive jackpot climbs above a certain amount that the player considers to be desirable (i.e., ripe for hitting). The player may proceed to the nearest game card vending machine or kiosk 60 and obtain one or more collectible game cards 54 to increase his/her chances of winning the jackpot. In some embodiments, the gaming machine 10 itself may provide the collectible game cards 54, for example, upon receipt of additional credits or as an award for achieving a certain wagering game outcome.

To the extent players must pay for the collectible game cards 54, the payments may be factored into the expected value of the gaming machine 10 and/or balanced out over the expected value of the entire casino (or several casinos). This can be accomplished by tracking the sales of the collectible game cards 54 using, for example, the computer-readable identifier for each game card 54 (mentioned above). Alternatively, the purchase price of each game card 54 may be stored on the game card itself, either as an actual purchase price or as a reference to a price list stored on the network. The gaming machine 10 may then read the purchase price off the game card 54 or look it up on the network when the game card 54 is inserted into the gaming machine. The gaming machine 10 may thereafter reconcile its expected value with the game card's purchase price (which may be updated from time to time as needed).

In some embodiments, the players may be required to belong to a casino players' club in order to obtain the collectible game cards 54. Membership in such a club may be provided as a reward to certain players for their high level of wagers. Alternatively, the casino players' club may be available to all players, but the casino may charge a membership fee that the casino can then use, at least in part, to pay for the collectible game cards 54. A portion of the membership fees may also be contributed to a community jackpot or otherwise factored into the expected value of the gaming machine 10.

In some embodiments, the collectible game cards 54 are provided "free of charge" to the players (i.e., the players do not directly pay for the game cards). In these embodiments, any marginal/additional value or benefit that the players may derive from the collectible game cards 54 may be accounted for in the expected value of the gaming machine 10. The gaming machine 10 may then award vouchers to the players during the course of game play (e.g., after completing a certain task) which the player may subsequently redeem for collectible game cards 54. Alternatively (or in addition), the collectible game cards 54 (or the vouchers therefor) may be given away to players as part of a promotional event to encourage the players to use them in the gaming machine 10.

In some embodiments, the collectible game cards 54 may be provided as individually selectable cards or in a pack or cards, or both. The packs of collectible game cards 54 may contain randomly-selected cards, or the cards in each pack may be related to one another in some logical way (e.g., a pack of "weapons" cards, a pack of "reel symbol" cards, etc.). Alternatively, a pack of collectible game cards 54 may contain, and be advertised as containing, one or more rare or difficult-to-find game cards 54 along with several commonly-available game cards 54. Players must then take the common or less desirable game cards 54 along with the rare game cards. The players may thereafter leave the common or less desirable game cards 54, for example at a designated location or some ad-hoc spot as communal cards that everyone may use.

The rarity of a collectible game card 54 may be based on the quality and/or quantity of the game card. For example, a particular game card may be difficult to find because only a few were created relative to other cards, or a large number may have been created, but a significantly larger number of wagering games exists that can accept that game card compared to other cards. As for quality, a player may prefer a particular game card because of the increased payout other players have attributed to the card (e.g., through word of mouth). The increase may be a perceived increase and/or it may be an actual increase. Or the player may simply like the design and/or artwork on the card. In any event, such game cards 54 are expected to be snatched up and hoarded as they become available. It is also possible for a certain game card 54 to be popular sometimes and common at other times, for example, as the novelty of the game card (or the wagering game that uses the game card) wears off, or as the jackpot for the wagering game that accepts the game card climbs above a certain desirable threshold.

Players may also exchange game cards 54 they have collected with one another. The exchange may occur online (e.g., via a casino-maintained website) or it may occur in person (e.g., a trading station on the casino floor). The players may exchange the collectible game cards 54 for money (e.g., via an online auction) or for other collectible game cards 54 of similar value. In some embodiments, the casino (or even the players) may maintain one or more listings of all available collectible game cards 54, or one or more subsets thereof. The listings may include collectible game cards 54 that have been found as well as those that are still available. Such listings may also provide a probability of finding a still-available game card 54, for example, based on the number created, number still available, number of players who have expressed a desire to obtain the card, and so forth. This allows a player to see whether his/her favorite game card 54 is still available and the likelihood of being able to obtain that card.

Once the collectible game cards 54 are obtained, a player may simply insert (or swipe) them into the gaming machine 10 via the card reader 52. If the player wishes to have access to more than one collectible game card 54 at a time, he/she may insert multiple game cards 54 into the card reader 52, albeit one game card 54 at a time. In some embodiments, the collectible game cards 54 must be inserted in a certain order or sequence for the player to obtain a certain enhancement. Inserting the same game cards 54 in another order or sequence results in another enhancement. The orders or sequences may be indicated on the game cards 54 themselves, or they may be provided by the wagering game and changed from time to time as needed. Or there may simply be no indication of which order or sequence results in which enhancement.

Figure 4:
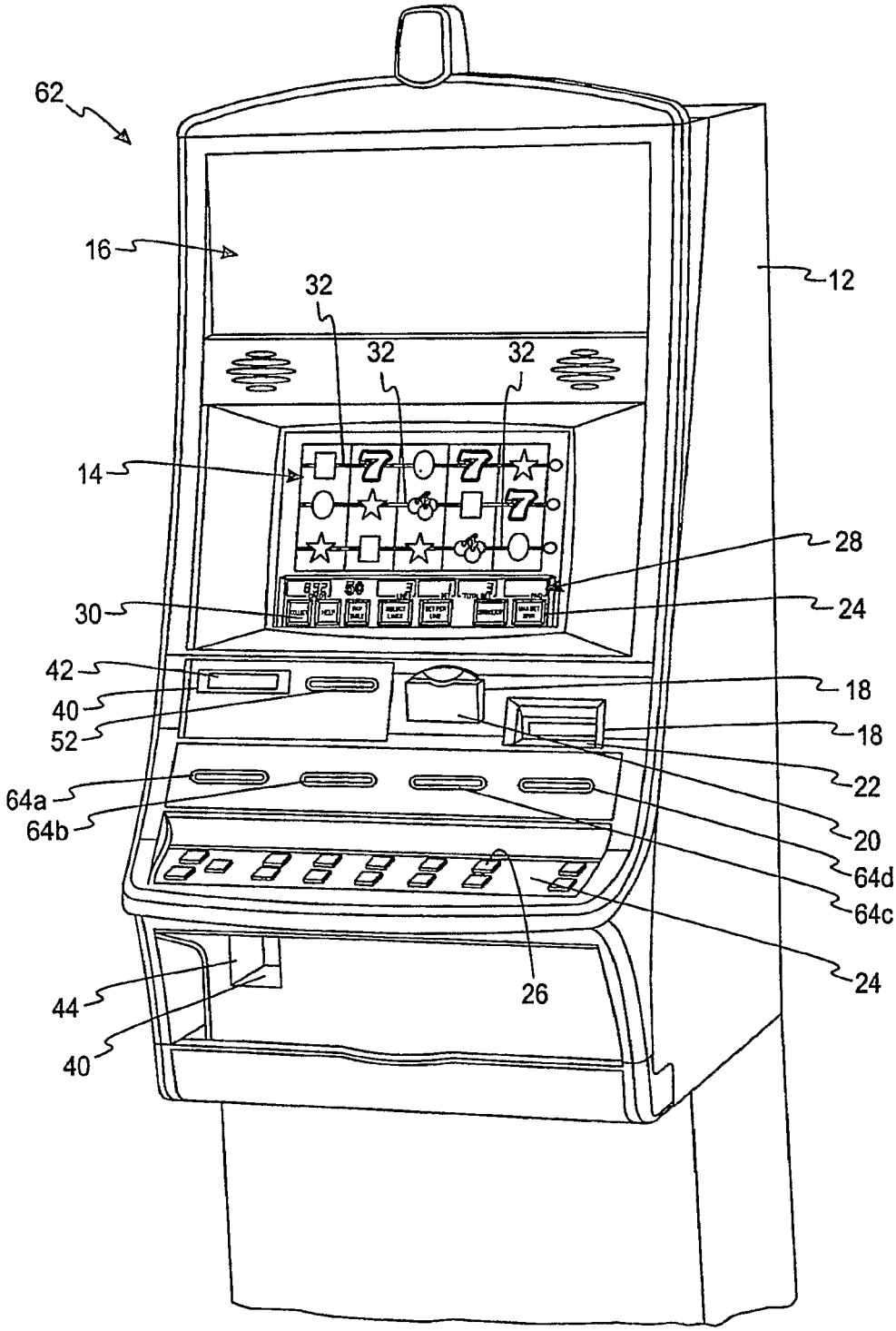
FIG. 4 is a perspective view of another gaming machine embodying the present invention.

Alternatively, in some embodiments, it is possible to have a gaming machine with multiple card readers, like the gaming machine 62 shown in FIG. 4. As can be seen, the gaming machine 62 includes a plurality of additional card readers 64*a*, 64*b*, 64*c*, and 64*d* that are similar to the card reader 52. The multiple card readers 64*a-d* allow players to insert more than one collectible game card 54 at a time into the gaming machine 62. Such an arrangement is particularly helpful where the wagering game requires them to remain in the card readers 64*a-d*. For example, in some embodiments, certain collectible game cards 54 must be placed in certain card readers 64*a-d* for the player to obtain a certain enhancement. Placing the same game cards 54 in different card readers 64*a-d* results in a different enhancement. The particular card readers 64*a-d* in which the game cards 54 must be placed may be indicated on the game cards 54 themselves, or they may be provided by the wagering game and changed from time to time as needed. Or there may simply be no indication of which card readers 64*a-d* results in which enhancements.

Figure 5:
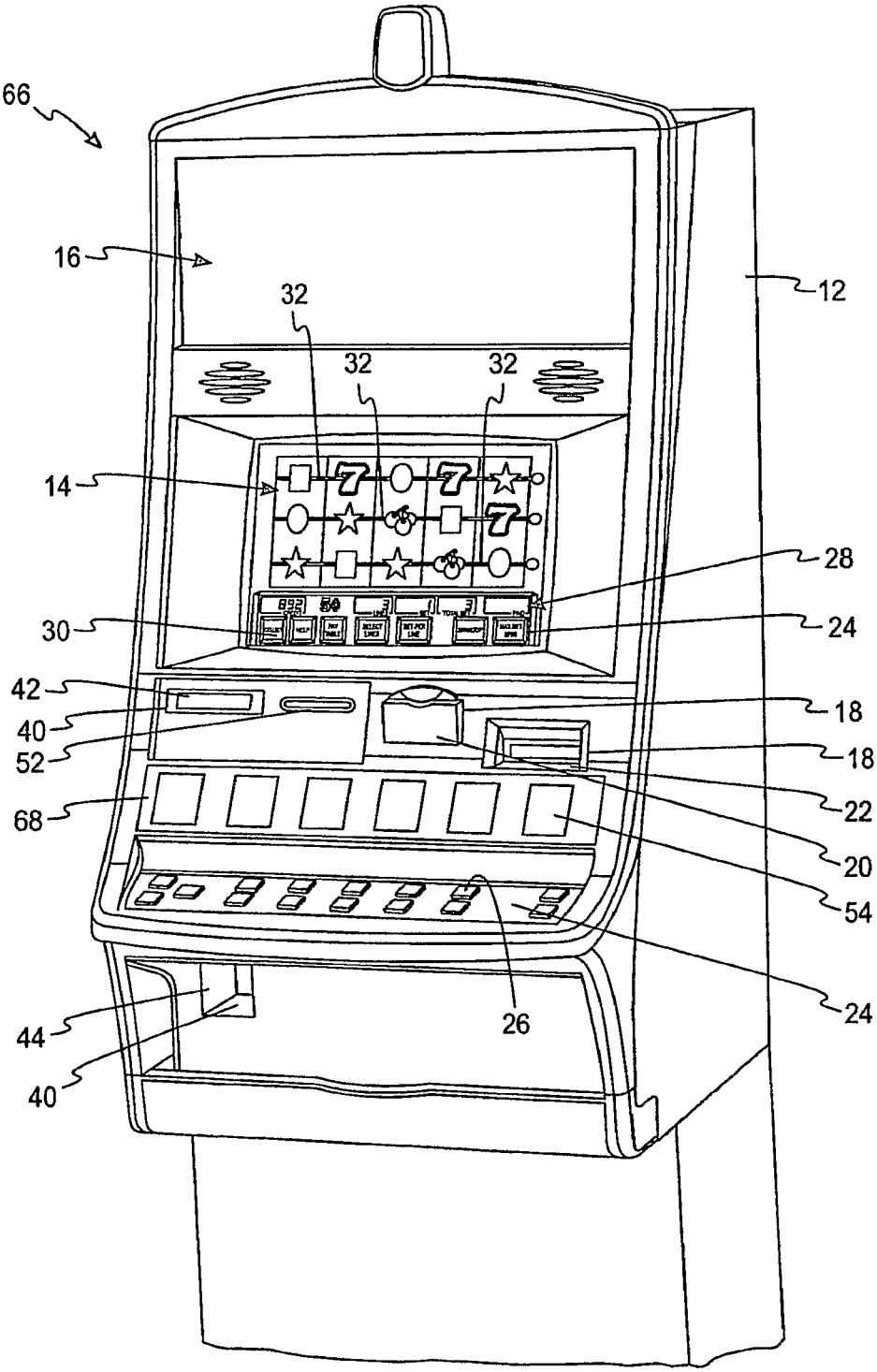
FIG. 5 is a perspective view of yet another gaming machine embodying the present invention.

In some embodiments, instead of multiple insertion style card readers like the card readers 64*a-d*, the gaming machine may have a single platform or table type card reader. FIG. 5 illustrates an example of a gaming machine 66 having a platform type card reader 68. The platform type card reader 68 may be built into the gaming machine 66 as shown here, or attached externally to the gaming machine 66. Players may then place multiple game cards 54 with the cards face down on the platform type card reader 68, and the card reader 68 reads the game cards 54 into the gaming machine 66. Such platform type card readers are known to those having ordinary skill in the art and are therefore not described in detail here.

Multiple gaming machines 10, 62, or 66 and their various card readers 52, 64*a-d*, or 68 may be linked together over a network. Players may then compete with each other over the network using their collectible game cards 54. The competition may involve informal game card duals between players, or the casino may promote and sponsor tournament style competitions involving multiple rounds of battling game cards 54. Such an arrangement encourages players to collect as many game cards 54 as possible as well as to collect game cards 54 of the highest possible quality in order to give themselves a competitive advantage over other players.

Although multiple game cards 54 may be read into a gaming machine 10, 62, or 66, not all the collectible game cards 54 may be used at once or even at all, depending on the current state of the wagering game. For example, a character game card such as a "dragon" card may be useful during an adventure type wagering game, but is not likely to be applicable in a free-spins type slot machine wagering game. Therefore, in some embodiments, the players must choose the particular game cards 54 to apply, perhaps at the prompting of the wagering game (e.g., "If you have a "monster warrior" card, play it now!"). Alternatively, in some embodiments, the wagering game may randomly select an appropriate game card 54 from those that were inserted into the gaming machine 10, 62, or 66 to apply. In some embodiments, the selection by the wagering game takes place only upon occurrence of a certain outcome in the wagering game (i.e., the outcome of the wagering game activates the game cards 54). Unused game cards 54 may be withdrawn at any time from the gaming machine 10, 62, or 66 or simply maintained in the gaming machine 10, 62, or 66 until they are needed.

As mentioned above, the collectible game cards 54 may provide a variety of enhancements for the wagering game, including new basic and/or bonus game features, augmented game characters, modified rules of game play, and the like. In general, the collectible game cards 54 may provide any enhancements that are normally implemented with traditional techniques as well as many enhancements that are not possible or practical to implement via traditional techniques. Following is a description of a few exemplary implementations of the collectible game cards 54 and some of the benefits that may be derived therefrom, beginning with new basic and/or bonus game features.

In one embodiment, the collectible game cards 54 may be used to allow a player to select a character or an item in a wagering game. For example, the wagering game may provide a talent contest in which there are several contestants. A player participates in the wagering game by voting for the contestant whom he/she thinks will win the talent contest, with the wagering game ultimately deciding the winning contestant by random selection. Such a wagering game may be modeled after the popular American Idol™ reality TV show from the American Broadcasting Company (ABC). The player may vote for a particular contestant by inserting a game card 54 corresponding to that contestant. If the contestant picked by the player turns out to be the winning contestant (as selected by the wagering game), the player is awarded a prize (e.g., jackpot, free spins, etc.). In order to vote for any contestant, however, the player must first collect/possess the game card 54 for that contestant. Certain contestants may have higher perceived and/or actual value than other contestants and, therefore, their game cards may be more difficult for the player to collect.

In another embodiment, the collectible game cards 54 may include one or more "avatar" cards that a player may use to select an avatar for play in a wagering game. This allows the player to deploy his/her favorite avatar across multiple wagering games, gaming machines 10, 62, or 66, and even casinos. The avatar may be any type of avatar, including living avatars (e.g., people, animals, plants, etc.) as well as inanimate objects (e.g., cars, trains, planes, ships, etc.). The player may simply insert his/her own avatar in place of the wagering game's avatar during the avatar selection process. A trusted and familiar avatar may encourage and inspire the player in certain situations that may otherwise be intimidating, for example, when the player is competing directly or indirectly against other players in a wagering game. The "avatar" cards are also useful when the player has a newer, more updated version of an avatar compared to one in the wagering game. The player may also add one or more avatars to the wagering game where multiple avatars are allowed (i.e., a group adventure).

In addition to new game features, the collectible game cards 54 may also provide character augmentations. For example, the collectible game cards 54 may include equipment or asset cards that a player may use to strengthen an avatar in a wagering game. Consider a wagering game involving an adventure in which a player must guide his/her avatar through a dark and enchanted forest. The player manipulates the avatar to overcome various hurdles, battle assorted creatures, and otherwise reach the objectives set forth in the wagering game. In accordance with embodiments of the invention, the collectible game cards 54 may include cards for equipping the avatar with various tools (e.g., a compass), weapons (e.g., a sword), armor (e.g., chain mail), and the like. These tools, weapons, armor, and the like may help the player accomplish the objectives set forth in the wagering game, thereby increasing the player's chance of achieving a winning outcome.

In some embodiments, intangible enhancements may be provided as well as tangible enhancements. For example, the collectible game cards 54 may include cards that bestow certain mental traits on the avatar, such as intelligence, knowledge, leadership, courage, judgment, abilities/skills, and the like. Other intangible enhancements may include bodily characteristics, such as strength, stamina, size, speed, and the like. Still other intangible enhancements may include extended or additional lives, health, immunity, and the like. As before, certain qualities and traits may have higher perceived and/or actual value than others and, as a result, the collectible game cards 54 for those qualities and traits may be more difficult for the players to collect.

The enhancements provided by the collectible game cards 54 generally last for the duration of the wagering game (or until the player removes the game cards). In some embodiments, however, the enhancements may expire based on usage and/or elapsed time. For example, the collectible game cards 54 may include an "ammunitions" card that provides a preset number of bullets, a "bomb" card that provides a preset number of explosions, various "equipment" cards that become worn out after a certain number of uses, and so forth. When a game card 54 expires, the wagering game may give the player an opportunity to replenish the expired game card 54, for example, by depositing additional credits. Of course, if the player already has replacement and/or alternative game cards 54, he/she may use the replacement cards instead. Partially expired game cards 54 may retain their usage balance across multiple wagering games and gaming machines 10, 62, or 66. Expired game cards 54 may be returned to the retail store 56, online merchant 58, or the vending machine or kiosk 60 to be renewed, reused, or retired as needed.

In addition to new game features and character augmentations, the collectible game cards 54 may also be used to modify the rules of a wagering game. Depending on the particular game cards 54, a different set of rules governing payouts, reel symbol behavior, winning combinations, and so forth may be applied to the wagering game. Following is a discussion of a few exemplary implementations of collectible game cards 54 that may be used to modify the rules of the wagering game.

In some embodiments, the collectible game cards 54 may include an "enhanced payout" card that may be used to earn increased payouts for a temporary period. By way of illustration, most wagering games have a pay table that indicates a certain number of credits for each winning symbol combination. A player who achieves a particular winning symbol combination is awarded the number of credits indicated by the pay table for that combination. However, by inserting the "enhanced payout" card, the player may increase some or all of the credit amounts listed on the pay table. The increase may be a certain multiplier (e.g., 2×, 3×, 4×, 5×, etc.), a certain percentage (e.g., 10%, 20%, 30%, 40%, etc.), or a combination of both, depending on the particular "enhanced payout" card used. Similarly, the duration of the increase may vary (e.g., 30 seconds, one minute, two minutes, etc.) according to the particular "enhanced payout" card used. The player must then achieve a winning outcome during this interval in order to benefit from the enhanced payout.

Not all collectible game cards 54 may be used with every wagering game. Indeed, each wagering game may have a different effect on the same game card 54, or the same wagering game may have a different effect on the same game card 54 from one round to the next. For example, the game card 54 may function less effectively or not at all from one round of the wagering game to the next, or from one wagering game to the next.

In some embodiments, the collectible game cards 54 may also affect the wagering game, for example, by altering the selection of the wagering game or the variations in the wagering game. Consider a wagering game with several possible missions or adventures. The collectible game cards 54 may allow a player to select the particular mission or adventure to be played. Such collectible game cards 54 may include an "explorer" card that may be used to select a jungle-based, adventure, or a "pirate" card that may be used to select a sea-based adventure, and the like. This allows the player to mix and match variations in the wagering game and even to select specific basic games and bonus games in various combinations. In these wagering games, however, although appearing to be under player control, each variation and the outcomes thereof are typically determined ahead of time based on the expected value of the gaming machine 10, 62, or 66 (i.e., the selections by the player merely customizes the presentation of a predetermined outcome).

In some embodiments, a wagering game may have multiple levels of missions or adventures, some of which may be "locked" to the players. The so-called lock may be in the form of a puzzle, for example, and the player must solve the puzzle in order to progress through the wagering game. In accordance with embodiments of the invention, the collectible game cards 54 may include a "key" card that may be used to solve the puzzle or otherwise unlock the locked missions or adventures. The "key" card may be specific to a particular mission or adventure, or it may be a "master key" card that may be used to unlock all locked missions or adventures (or locked missions or adventures of a certain type), thus making the card more difficult to collect.

Similar to the "key" card, in some embodiments, the collectible game cards 54 may allow a player to participate in a group or communal event. For example, the casino may have a group or communal wagering game (e.g., the "Big Event") in which all eligible players may participate. In accordance with embodiments of the invention, the collectible game cards 54 may include a special "eligibility" card (e.g., a "Big Event" card) that allows the player to access the group or communal wagering game. The "eligibility" card may have varying degrees of eligibility and the player must collect the correct one in order to participate at all, or all players with "eligibility" cards may participate, but at different levels of eligibility.

In some embodiments, the collectible game cards 54 may include a "ramp-up" card that may be used to modify the expected value of the gaming machine 10, 62, or 66. Most gaming machines 10, 62, or 66 have a certain expected value built into the programming of the gaming machines 10, 62, or 66. In accordance with embodiments of invention, the "ramp-up" card may be used to increase the expected value of the gaming machine 10, 62, or 66. The increase in the expected value may be for a temporary period (e.g., 30 seconds, one minute, two minutes, etc.), or it may last for the duration of the gaming session. Such a "ramp-up" card increases the chance that the player will win an award, or increases the size of the potential award the player may win.

In some embodiments, the collectible game cards 54 may include a "wild" card that may be used to convert game symbols into wild symbols. For example, the wagering game may involve a number of reels, each reel having a plurality of reel symbols. A player may use the "wild" card to turn one or more reel symbols into wild symbols. The "wild" card may convert specific reel symbols (e.g., all "cherry" symbols) into wild symbols, or it may convert entire rows or columns of reel symbols into wild symbols, as indicated on the face of the card. In some embodiments, the symbol that is converted may also be randomly selected by the wagering game. For example, upon insertion of the "wild" card, an animated character may be shown moving aimlessly over the reel symbols. Wherever the character stops, that reel or reel symbol turns into a wild symbol.

In some embodiments, instead of wild symbols, the collectible game cards 54 may include a "scatter" card that may be used to convert game symbols into "scatter" symbols. These "scatter" symbols, as the name implies, are not required to be aligned along an active payline to produce a winning outcome. The "scatter" card may convert specific symbols (e.g., all "bar" symbols), or it may convert randomly-selected symbols, as indicated on the face of the card. Such a "scatter" card allows a player to achieve a winning outcome from an otherwise non-winning outcome.

In some embodiments, the collectible game cards 54 may include a "multiplier" card that may be used to multiply a player's winnings. When inserted, the "multiplier" card causes any credit amount won by the player to be multiplied by a predetermined multiplier (e.g., 2×, 3×, 4×, 5×, etc.). The multiplier may be a known multiplier that is advertised on the face of the card, or there may be several multipliers advertised on the face of the card, and the wagering game either randomly selects one of the multipliers, or prompts the player to select one of the multipliers.

In some embodiments, the collectible game cards 54 may include a "mystery" card, the function of which may be randomly selected from a plurality of functions. These functions may include any of the functions described above as well as other functions not specifically discussed, but known to those having ordinary skill in the art. The "mystery" card may contain some or all of these functions and the wagering game may randomly select a function each time the player inserts the card. Or the "mystery" card may contain only a single function, but one that is unknown to the player. Alternatively, the "mystery" card may contain merely an identifier identifying itself as a "mystery" card and the wagering game selects the function corresponding to that identifier from a list of functions stored on the gaming machine 10, 62, or 66 or the gaming network (which list may be modified from time to time as needed).

In some embodiments, the collectible game cards 54 may include "combination" cards. "Combination" cards are cards that must be combined with other cards and/or with items in the wagering game in order to maximize their benefit. Examples of "combination" cards may include a "bow" card and an "arrow" card, a "ying" card and a "yang" card, cards representing the properties in a Monopoly™ board game, and the like. Although some intermediate benefit may be available, only when the combination is complete can the player obtain the maximum benefit from these cards. Such an arrangement may encourage players who have collected part of a combination to trade with one another in order to complete the combination.

In some embodiments, the functions of two or more collectible game cards 54 may be combined into a single game card 54. By way of illustration, the "bow" card and the "arrow" card may be combined into a single "bow and arrow" card, or the "ying" card and a "yang" card may be combined into a single "ying and yang" card. The combining may be performed by any suitable means, including the vending machine or kiosk 60, the gaming machine 10, 62, or 66, and the like. For example, the vending machine or kiosk 60 (or the gaming machine 10, 62, or 66) may have a supply of blank game cards. When a player inserts one or more game cards to be combined, the vending machine or kiosk 60 (or the gaming machine 10, 62, or 66) programs one of the blank game cards with the selected function, imprints it with the appropriate artwork, and provides the new card to the player it is also possible for the inserted game cards to be reprogrammable, in which case the vending machine or kiosk 60 (or the gaming machine 10, 62, or 66) simply reprograms one of the inserted cards with the combination function.

The above embodiments allow existing game cards 54 themselves to be augmented with new functions in much the same way that avatars may be augmented. For example, a "starship" card may be augmented with photon torpedoes, a warp drive, shields, and the like, each augmentation providing further benefits during a wagering game. However, a player must first obtain a "photon torpedo" card, a "warp drive" card, a "shields" card, and the like, before he/she can complete the augmentation. Such an arrangement may further encourage players to collect and trade cards with one another, for example, in order to fully accessorize their favorite cards. In some embodiments, the vending machine or kiosk 60 (or the gaming machine 10, 62, or 66) may also update the graphics and images on the front and/or back of the updated card to reflect the new capability of the card (e.g., the starship may be shown with a photon torpedo icon).

In some embodiments, the combining of game cards 54 may result in a randomly-selected "mystery" function. For example, a player may insert two game cards with known functions, such as a "health" card and a "strength" card, and the vending machine or kiosk 60 (or the gaming machine 10, 62, or 66) may return a card having an unknown function, such as the "key" card mentioned earlier. The "mystery" function may be of similar value to the function of the inserted game cards, or it may be of significantly lower value or significantly higher value. In such embodiments, the player is essentially playing a wagering game using his/her known game cards as the wager.

Each of these embodiments and obvious variations thereof is contemplated as falling within the spirit and scope of the claimed invention, which is set forth in the following claims.

What is claimed is:

1. A gaming machine, comprising:

a wager input device operable to accept a wager input from a player at said gaming machine;

a game display operable to display an outcome of said wagering game in response to said wager input, said outcome being randomly selected from a plurality of available outcomes for said wagering game; and a data input device configured to receive a plurality of handheld data storage media and operable to read data stored on said plurality of handheld data storage media into said gaming machine, each handheld data storage media storing data representing one or more potential enhancements for said wagering game;

wherein said game display is operable to present at least one predetermined enhancement to said player in response to said data input device reading said plurality of handheld data storage media, said at least one predetermined enhancement being based on a sequence in which said plurality of said handheld data storage media are read by said data input device, said at least one predetermined enhancement including a first enhancement when said plurality of said handheld data storage media are entered in a first sequence and said at least one predetermined enhancement including a second enhancement when said plurality of said handheld data storage media are entered in a second sequence, said first enhancement being different than said second enhancement.

2. The gaming machine according to claim 1, wherein said at least one enhancement is independent of previous wagering games played by said player.

3. The gaming machine according to claim 1, wherein said at least one enhancement comprises one or more game feature enhancements.

4. The gaming machine according to claim 1, wherein said at least one enhancement comprises one or more game character enhancements.

5. The gaming machine according to claim 4, wherein said one or more game character enhancements comprise tangible assets for a game character in said wagering game.

6. The gaming machine according to claim 4, wherein said one or more game character enhancements comprise intangible assets for a game character in said wagering game.

7. The gaming machine according to claim 1, wherein said at least one enhancement comprises one or more rule modifications for said wagering game.

8. The gaming machine according to claim 7, wherein said one or more-rule modifications for said wagering game comprise one or more of enhancement of payouts, selection of wagering game variations, unlocking of locked wagering games, ramping up of an expected value of said wagering game, conversion to wild symbol, conversion to scatter symbol, multiplication of winnings, performing of mystery functions, and combining of functions.

9. The gaming machine according to claim 1, wherein said data input device is a platform-type card reader configured to simultaneously receive each of said plurality of handheld storage media.

10. A method of conducting a wagering game on a wagering game system, the method comprising:

receiving a wager via a player input device of a wagering game machine of the wagering game system;

initiating a wagering game, via a controller for the wagering game, in response to receiving said wager;

reading, via a game card reader, data from a plurality of game cards, each of said data from each of said plurality of game cards representing one or more potential enhancements for said wagering game;

and presenting at least one enhancement during said wagering game in response to said data from said plurality of game cards being read into said gaming machine, said at least one enhancement being based on a sequence in which each of said plurality of game cards was read via said game card reader.

11. The method according to claim 10, further comprising providing said plurality of game cards to said player for a fee and factoring said fee into an expected value of said wagering game.

12. The method according to claim 10, further comprising providing said plurality of game cards to said player free of charge and factoring any additional benefits said player may derive from said plurality of game cards into an expected value of said wagering game.

13. The method according to claim 10, further comprising allowing said player to select one or more of said plurality of game cards to be read into said gaming system.

14. The method according to claim 10, further comprising randomly selecting one or more of said plurality of game cards to be read into said gaming system.

15. The method according to claim 10, further comprising offering said player an opportunity to replenish one or more of said plurality of game cards when said one or more of said plurality of game cards expire.

16. The method according to claim 10, wherein said wagering game is a multi-player wagering game in which multiple players compete against one another using said plurality of game cards, each player having a respective set of game cards.

17. The method according to claim 10, further comprising customizing an artwork for each game card according to one or more enhancements represented by said game card.

18. The method according to claim 10, wherein said at least one enhancement unlocks an aspect of said wagering game.

19. The method according to claim 10, wherein said at least one enhancement is further based on a state of said wagering game.

20. The method according to claim 10, wherein said plurality of game cards include an indication of said sequence and said at least one enhancement.

21. A method of conducting a wagering game on a wagering game system including a wagering game machine conducting the wagering game thereon, the method comprising:

providing a plurality of game cards operatively associated with the wagering game, each of said plurality of game cards being associated with data representing one or more potential enhancements for said wagering game conducted on the wagering game machine, said plurality of game cards including a first game card and a second game card;

processing, via a game controller, data associated with said first game card;

processing, via said game controller, data associated with said second game card;

in response to said data associated with said first game card being processed prior to said data associated with said second game card being processed, presenting at least a first enhancement for said wagering game; and in response to said data associated with said second game card being processed prior to said data associated with said first game card being processed, presenting at least a second enhancement for said wagering game, said first enhancement being different than said second enhancement.

22. The method according to claim 21, wherein said plurality of game cards are virtual game cards stored on a network.

23. The method according to claim 21, wherein said providing comprises endowing at least one of said plurality of game cards with a function that complements at least another one of said plurality of game cards.

24. The method according to claim 21, wherein said providing comprises endowing at least one of said plurality of game cards with a function that only works when combined with at least another one of said plurality of game cards.

25. The method according to claim 21, wherein said plurality of game cards comprise tangible objects configured to store said associated data, the method further comprising reading data borne by said plurality of game cards, via a game card reader of the wagering game machine.

26. The method according to claim 21, wherein said providing comprises establishing an wagering game system based exchange for said game cards, said exchange allowing trade of said plurality of game cards on the wagering game system between players at different wagering game machines of said wagering game system.

27. The method according to claim 21, wherein said plurality of game cards comprise virtual objects retrievably digitally stored on a network, the method further comprising retrieving data indicative of one or more of said plurality of game cards via the network in response to a signal from a user input device.

* * * * *

UNITED STATES PATENT AND TRADEMARK OFFICE

CERTIFICATE OF CORRECTION

PATENT NO. : 8,840,459 B2
APPLICATION NO. : 12/161837
DATED : September 23, 2014
INVENTOR(S) : Peter R. Anderson et al.

It is certified that error appears in the above-identified patent and that said Letters Patent is hereby corrected as shown below:

On the Title Page, Item (75), change the city for Inventor Peter R. Anderson to "Glenview, IL".

On the Title Page, Item (75), change the city for Inventor Larry J. Pacey to "Chicago, IL".

Signed and Sealed this
Twenty-fourth Day of March, 2015

Michelle K. Lee

Michelle K. Lee
*Director of the United States Patent and Trademark Office*